US011754028B2

(12) United States Patent
Thiel et al.

(10) Patent No.: US 11,754,028 B2
(45) Date of Patent: Sep. 12, 2023

(54) FUEL SYSTEM DIAPHRAGM VALVE

(71) Applicant: Ford Global Technologies, LLC, Dearborn, MI (US)

(72) Inventors: Steven Antone Thiel, Chelsea, MI (US); Ross Pursifull, Dearborn, MI (US); Christopher Woodring, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 56 days.

(21) Appl. No.: 17/304,601

(22) Filed: Jun. 23, 2021

(65) Prior Publication Data

US 2022/0412298 A1 Dec. 29, 2022

(51) Int. Cl.

| | |
|---|---|
| ***F02M 69/46*** | (2006.01) |
| ***F02M 55/02*** | (2006.01) |
| ***F02M 59/46*** | (2006.01) |
| ***F02M 69/52*** | (2006.01) |
| ***F02M 37/00*** | (2006.01) |

(52) U.S. Cl.

CPC ..... *F02M 69/465* (2013.01); *F02M 37/0023* (2013.01); *F02M 55/025* (2013.01); *F02M 59/462* (2013.01); *F02M 69/462* (2013.01); *F02M 69/52* (2013.01)

(58) Field of Classification Search

None

See application file for complete search history.

(56) References Cited

U.S. PATENT DOCUMENTS 4,530,329 A * 7/1985 Maisch ..... F02M 69/462 123/446
4,951,636 A * 8/1990 Tuckey ..... F02D 33/006 123/41.31
5,259,412 A * 11/1993 Scott ..... F02M 37/0023 123/519
5,289,810 A * 3/1994 Bauer ..... F02M 37/025 123/514
5,297,578 A * 3/1994 Scott ..... F02M 37/0023 137/590
5,398,655 A * 3/1995 Tuckey ..... G05D 16/0655 123/456

(Continued)

FOREIGN PATENT DOCUMENTS

CA 965319 A * 4/1975 ..... F02M 51/0675
DE 19522514 A1 * 1/1996 ..... F02D 33/003

(Continued)

OTHER PUBLICATIONS

Pursifull, R., "Fuel Rail Pressure Relief," Proceedings of the 2006 SAE World Congress, Apr. 3, 2006, Detroit Michigan,13 pages.

(Continued)

*Primary Examiner* — Kevin R Steckbauer

(74) *Attorney, Agent, or Firm* — Vincent Mastrogiacomo; McCoy Russell LLP

(57) ABSTRACT

A fuel line check valve system and a fuel system that includes the fuel line diaphragm valve system are described. The fuel line diaphragm valve system may prevent flow into a fuel system that is generated via a vacuum in the fuel system. The fuel line diaphragm valve may also remain in an open state after it is open via a reduced pressure.

17 Claims, 5 Drawing Sheets

(56) References Cited

U.S. PATENT DOCUMENTS 5,409,035 A * 4/1995 Scott ..... F02M 25/0836 137/907
5,413,077 A * 5/1995 Hornby ..... F02M 69/54 123/460
5,509,390 A * 4/1996 Tuckey ..... F02M 37/0035 123/497
5,524,592 A * 6/1996 Woody ..... F02M 69/462 137/462
5,551,404 A * 9/1996 Bauerle ..... F02M 69/462 123/541
5,579,739 A * 12/1996 Tuckey ..... G05D 29/00 123/463
5,590,631 A * 1/1997 Tuckey ..... F02M 37/0041 123/456
5,655,504 A * 8/1997 Iwai ..... F02M 37/0047 123/514
5,711,263 A * 1/1998 Brown ..... F02M 37/0023 123/179.9
5,711,275 A * 1/1998 Minagawa ..... F02D 41/3836 123/179.17
5,727,529 A * 3/1998 Tuckey ..... F02M 37/20 123/514
5,791,317 A * 8/1998 Eck ..... F16K 15/044 123/514
5,842,455 A * 12/1998 Tuckey ..... F02M 69/465 123/514
5,873,349 A * 2/1999 Tuckey ..... F02M 69/54 123/514
5,934,251 A * 8/1999 Jacobs ..... F02M 37/0041 123/463
6,296,012 B1 * 10/2001 Kilgore ..... F02M 37/20 123/460
6,497,215 B1 * 12/2002 Gaessler ..... F02M 59/18 123/179.17
6,520,162 B1 * 2/2003 Schueler ..... F02M 37/40 210/90
6,918,381 B2 * 7/2005 Palvolgyi ..... F02M 69/462 123/514
6,988,488 B2 1/2006 Pursifull et al.
7,066,152 B2 6/2006 Stroia et al.
7,278,402 B2 * 10/2007 Schelhas ..... G05D 16/0658 123/446
7,568,472 B2 * 8/2009 Woody ..... F02M 7/12 123/517
7,624,720 B1 * 12/2009 Dokas ..... F02M 63/0235 123/457
8,434,461 B2 5/2013 Kerns et al.
8,522,751 B2 * 9/2013 DeLeon ..... F02M 37/0023 251/129.01
9,243,588 B2 1/2016 Pursifull
9,273,638 B2 * 3/2016 Pursifull ..... F02M 21/0239
10,519,908 B2 * 12/2019 Ono ..... F02M 37/04
11,015,555 B2 * 5/2021 Eberle ..... F02M 37/0052
2004/0250795 A1 * 12/2004 Stroia ..... F02M 37/0082 123/467
2005/0034710 A1 * 2/2005 Crary ..... F16K 35/00 123/457
2006/0225711 A1 * 10/2006 Schelhas ..... F02M 69/54 123/460
2008/0178849 A1 7/2008 Crary
2012/0048238 A1 * 3/2012 DeLeon ..... F02M 45/086 123/458
2013/0240066 A1 * 9/2013 Ono ..... F02M 37/24 137/565.01
2017/0204822 A1 * 7/2017 Ono ..... F02M 37/0058
2020/0392926 A1 * 12/2020 Eberle ..... B60K 15/03

FOREIGN PATENT DOCUMENTS

DE 19522512 A1 * 2/1996 ..... F02D 33/003
DE 19510497 A1 * 9/1996 ..... F02M 37/0029
DE 19528737 A1 * 11/1996 ..... F02D 33/003
DE 19544564 A1 * 6/1997 ..... F02M 37/16
DE 19805070 A1 * 8/1999 ..... B60K 15/077
DE 19805070 C2 * 11/1999 ..... B60K 15/077
DE 10337850 A1 * 3/2005 ..... F02M 69/54
DE 102011117534 A1 * 5/2013 ..... F02M 55/04
DE 102012208106 A1 * 11/2013 ..... F02M 55/002
DE 102012016499 A1 * 12/2013 ..... F02D 33/006
DE 102014214886 A1 * 2/2016 ..... F02M 37/00
DE 102017007603 A1 * 2/2019 ..... B60K 15/03
DE 102019100848 A1 7/2019
EP 2664784 A1 * 11/2013 ..... F02M 55/002
FR 2721354 A1 * 12/1995 ..... F02D 33/003
FR 2731252 A1 * 9/1996 ..... F02D 33/003
GB 2132701 A * 7/1984 ..... F02M 55/00
JP 2000265924 A * 9/2000
JP 2005030367 A 2/2005
JP 3914583 B2 * 5/2007 ..... F02D 33/003
JP 4083015 B2 * 4/2008 ..... F02M 37/0029
JP 4399697 B2 * 1/2010 ..... F02M 37/0035
RU 177954 U1 * 3/2018
WO WO-9940313 A1 * 8/1999 ..... B60K 15/077
WO WO-0042317 A1 * 7/2000 ..... F02M 37/20
WO WO-02055873 A1 * 7/2002 ..... F02M 37/0029
WO WO-2005017346 A1 * 2/2005 ..... F02M 69/54

OTHER PUBLICATIONS

Woodring, C. et al., "Fuel System Checkvalve," U.S. Appl. No. 17/196,938, filed Mar. 9, 2021, 33 pages.

* cited by examiner

FUEL SYSTEM DIAPHRAGM VALVE

FIELD

The present description relates to a fuel system diaphragm valve and method for operating the fuel system diaphragm valve.

BACKGROUND AND SUMMARY

Fuel injected engines may include a fuel rail, fuel pump, fuel injectors, and a fuel filter. The fuel pump may supply pressurized fuel to the fuel rail where fuel injectors may inject fuel to cylinders of an engine. If the fuel pump is stopped there may be potential for fuel to flow back from the fuel rail and past the fuel pump, thereby reducing pressure in the fuel rail. The reduced pressure in the fuel rail may lengthen engine starts when the engine is warm. One way to maintain pressure in the fuel rail so that the engine may quickly be restarted is to install a check valve in a fuel line that couples the fuel pump to the fuel rail. The check valve may reduce fuel pressure loss between frequent engine starts, but it may also contribute to evaporative emissions while an engine is stopped. In particular, a check valve may be configured to open at a low pressure differential in a forward flow direction (e.g. a direction that fluid flows from the fuel pump) when a fuel pump supplies fuel to the fuel rail. By the check valve opening at a lower pressure differential, the fuel pump may consume less energy when it is operating. However, if a vehicle that includes the fuel pump and check valve is stopped and it is exposed to diurnal heating and cooling, a vacuum may develop in a fuel line and fuel rail when fuel in the fuel line/rail cools. The vacuum may pull fuel from the tank through the fuel pump and check valve to enter the fuel rail. During subsequent diurnal heating, the fuel that was admitted into the fuel rail may increase in pressure, which may allow it to slip past fuel injector nozzles and into engine cylinders where it may contribute to evaporative emissions during engine-off. This process may be repeated several times if a vehicle is parked and is allowed to undergo diurnal heating and cooling over several days. Therefore, it may be desirable to provide a way controlling/limiting pressure within a fuel system that may be exposed to diurnal heating and cooling.

Further, during a period of deactivation of the fuel pump, if a part of the fuel line is disconnected, undesired fuel may siphon out of the fuel tank (even with the fuel pump not operating). This siphoning may be reduced by the check valve but with pressurized tanks, such as used in hybrid vehicles, the pressure to open the check valve may be as high as 8 psi which causes an increase in fuel pump electrical power consumption. Therefore, it may be desirable to provide a way to balance reducing siphoning and reducing a pressure drop that increases electrical power consumption.

The inventors herein have recognized the above-mentioned issues and have developed a fuel system, comprising: a diaphragm valve coupled to a fuel line between a fuel pump and a fuel rail, the diaphragm valve including a diaphragm movable within a chamber of the diaphragm valve via a spring. In this way, by using a cost effective component such as a diaphragm valve in the fuel line, regulation of fuel flow between the fuel pump and the fuel rail may be carried out.

In one example, a diaphragm valve may be housed in the fuel line downstream of the fuel tank and a filter and upstream of a check valve and the fuel rail. When the pump is operational, the diaphragm valve may be fully open to allow flow of fuel to the fuel rail. When the pump is inactive, an impediment of a higher than threshold pressure (such as above 10 psi) is provided by the diaphragm valve for fuel to flow from the tank to the fuel line.

The present description may provide several advantages. By limiting fuel flow in a fuel system via a valve such as a diaphragm valve, it may be possible to hold the valve closed during diurnal conditions so that subsequent pressure build up during diurnal conditions may be avoided. Specifically, the approach may reduce evaporative emissions from an engine of a vehicle. The technical effect of using a diaphragm valve is that once open, the diaphragm valve may be held open with very little pressure difference across the valve such that power consumption of a fuel pump may be reduced. In addition, the approach may simplify fuel system design with a cost effective component. Since the diaphragm valve system may be held open with the pump outlet pressure a threshold amount (such as 10 psi) greater than tank pressure, the pressure required by the pump to pump fuel (with pump on) may be reduced while preventing fuel flow with pump off, notwithstanding a pressurized tank or a fuel rail vacuum.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where:

FIGS. 1-3B are drawn approximately to scale, however, other relative dimensions may be used, in other embodiments.

DETAILED DESCRIPTION

Figure 2B:
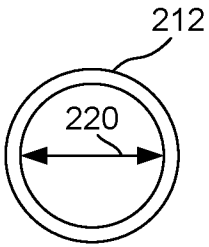
FIG. 2B shows a cross section of a fuel line.
Figure 2A:
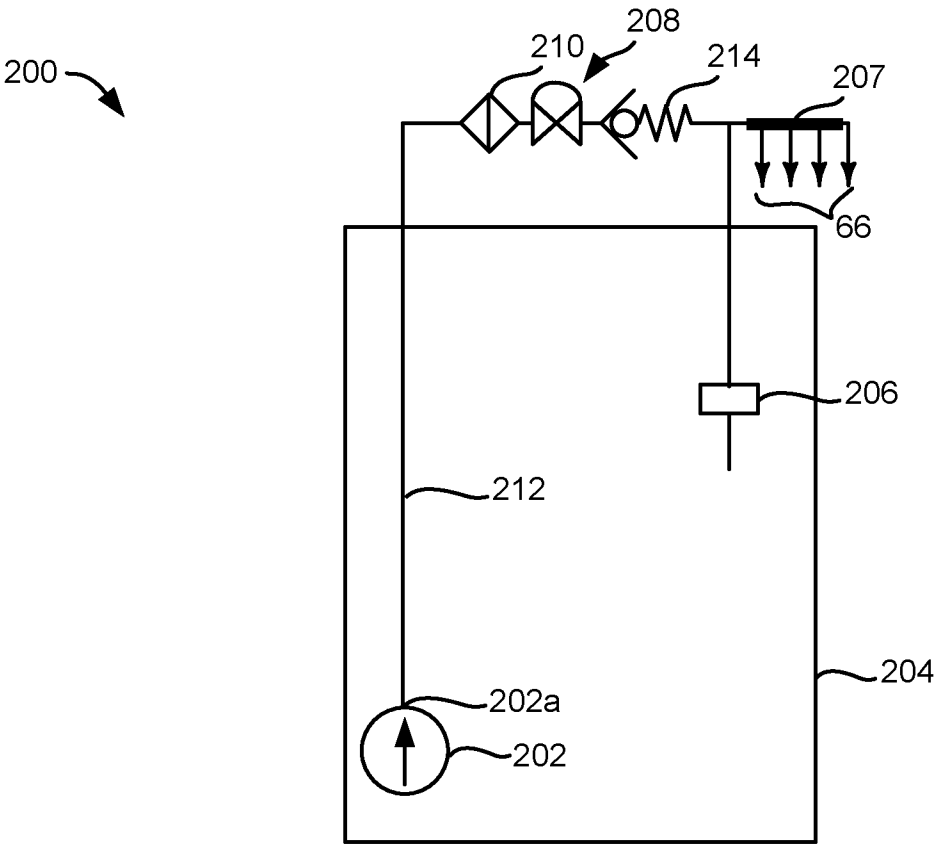
FIG. 2A is a schematic diagram that shows a fuel system including a diaphragm valve.
Figure 3B:
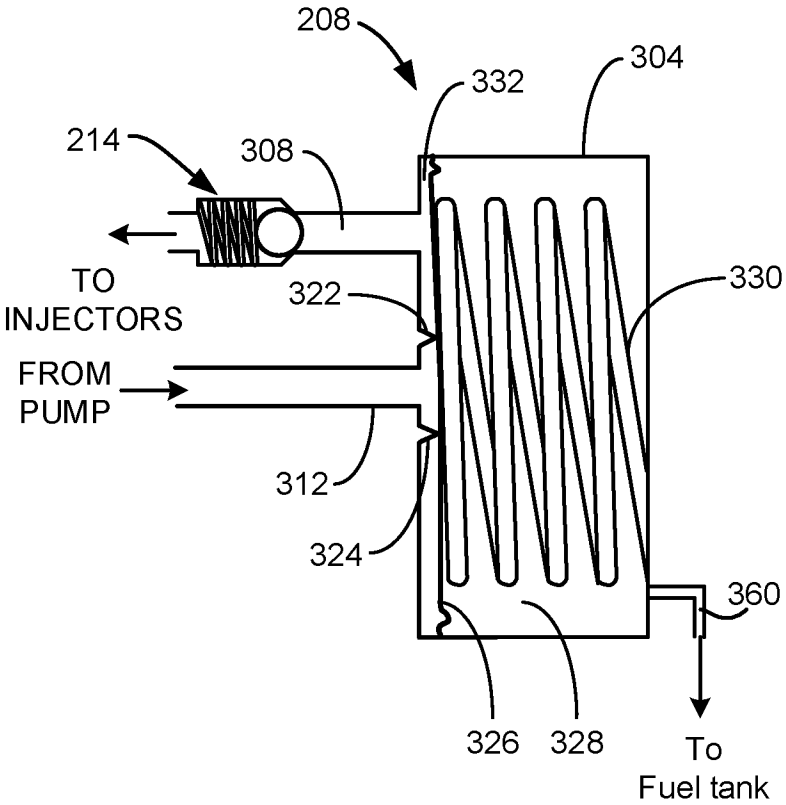
FIG. 3B shows a cut-away view of the diaphragm valve in a closed position.
Figure 3A:
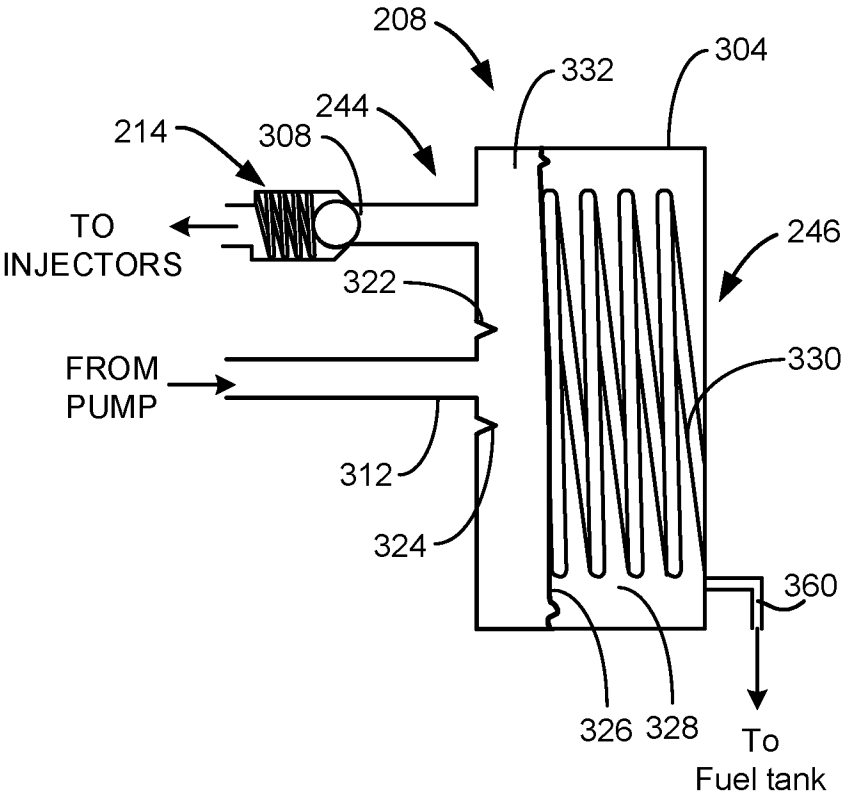
FIG. 3A shows a cut-away view of the diaphragm valve in an open position.

The present description is related to a diaphragm valve for a fuel line of a vehicle and operation of the diaphragm valve while an engine of the vehicle is stopped. The vehicle may undergo diurnal heating and cooling, but fuel pressure in a fuel rail may be limited by the diaphragm valve so that a possibility of unintended discharge of fuel from fuel injectors may be reduced. The diaphragm valve may be incorporated into a fuel line for an engine of the type shown in FIG. 1. The fuel line may be included in a fuel system as shown in FIGS. 2A and 2B. The diaphragm valve may be configured as shown in FIGS. 3A-3B. The diaphragm valve may operate according to the sequence shown in FIG. 4 and the method of FIG. 5.

Figure 1:
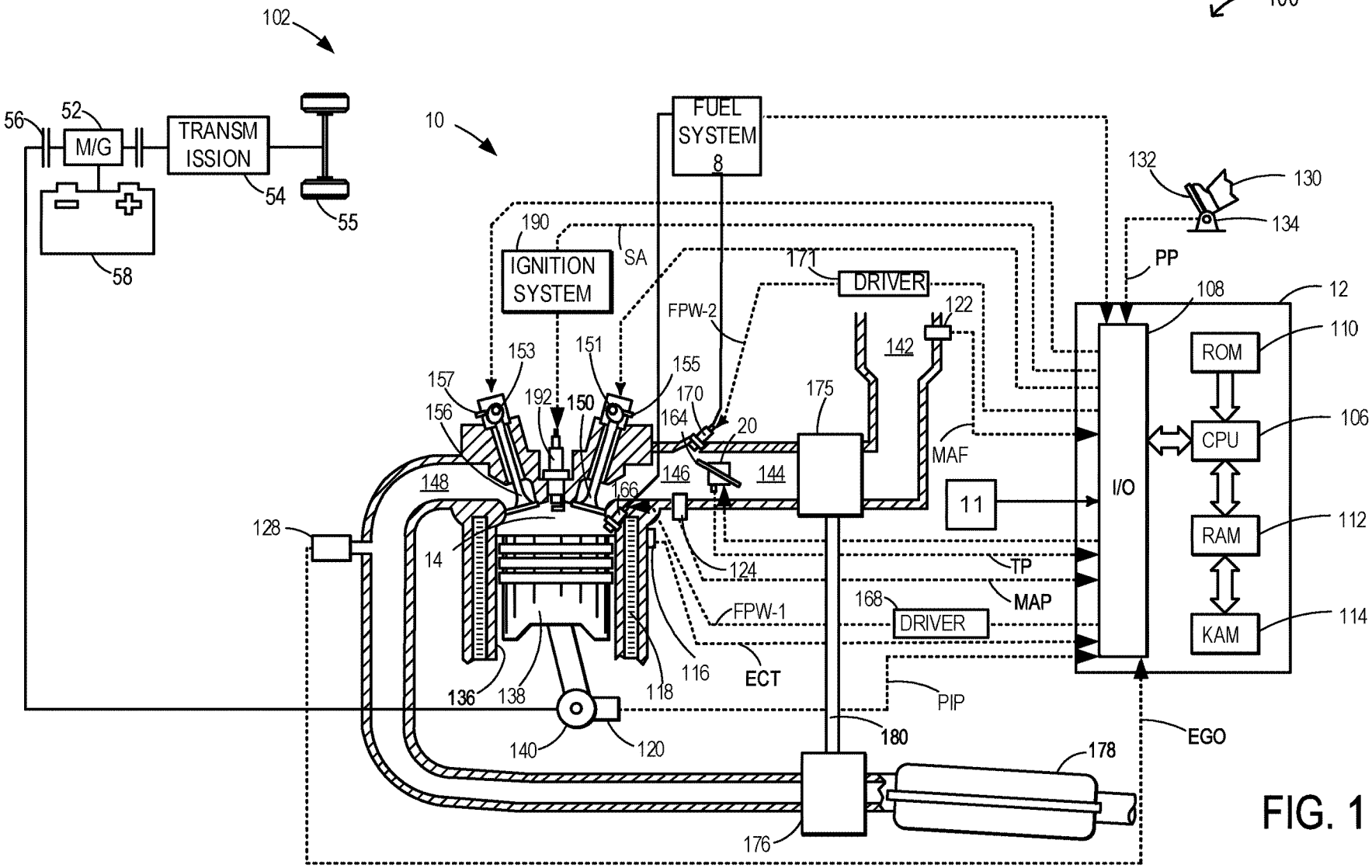
FIG. 1 shows an example engine system for a vehicle including a fuel system.

FIG. 1 depicts an example embodiment 100 of a hybrid vehicle 102 including a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 175 arranged between intake passages 142 and 144, and an exhaust turbine 176 arranged along exhaust passage 148. Compressor 175 may be at least partially powered by exhaust turbine 176 via a shaft 180 where the boosting device is configured as a turbocharger. The turbocharger may be a variable geometry turbocharge (VGT) where exhaust turbine 176 may include guiding vanes arranged in a nozzle of the turbine. Gas flow into the exhaust turbine 176 may be adjusted by varying a position of the guiding vanes. A throttle 20 including a throttle plate 164 may be provided along an intake passage of the engine for varying the flow rate and/or pressure of intake air provided to the engine cylinders. For example, throttle 20 may be disposed downstream of compressor 175 as shown in FIG. 1, or alternatively provided upstream of compressor 175.

Exhaust passage 148 may receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be measured by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

As a non-limiting example, cylinder 14 is shown including two fuel injectors 166 and 170. Fuel injector 166 is configured to deliver diesel or gasoline to the combustion chamber from fuel system 8 via a high pressure fuel pump, and a fuel rail. Alternatively, fuel may be delivered by a single stage fuel pump at lower pressure, in which case the timing of the direct fuel injection may be more limited during the compression stroke than if a high pressure fuel system is used. Further, the fuel tank may have a pressure transducer providing a signal to controller 12.

Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alternative, alcohol-based fuel due to the lower volatility of some alcohol-based fuels. Alternatively, the injector may be located overhead and near the intake valve to improve mixing.

Fuel injector 170 is shown arranged in intake passage 146, rather than in cylinder 14, in an optional configuration that provides what is known as port injection of fuel (hereafter referred to as "PFI") into the intake port upstream of cylinder 14. Fuel injector 170 may inject fuel such as gasoline, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

As described above, FIG. 1 shows only one cylinder of a multi-cylinder engine. As such each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14. The engine may include one or more exhaust gas recirculation passages for recirculating a portion of exhaust gas from the engine exhaust to the engine intake.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Storage medium read-only memory 110 can be programmed with computer readable data representing instructions executable by processor 106 for performing the methods described below as well as other variants that are anticipated but not specifically listed.

Controller 12 may also receive input from human/machine interface 11. A request to start the engine or vehicle may be generated via a human and input to the human/machine interface 11. The human/machine interface 11 may be a touch screen display, pushbutton, key switch or other known device.

During operation, each cylinder within engine 10 typically undergoes a four stroke cycle: the cycle includes the intake stroke, compression stroke, expansion stroke, and exhaust stroke. During the intake stroke, generally, the exhaust valve 156 closes and intake valve 150 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 150 and exhaust valve 156 are closed. Piston 138 moves toward the cylinder head so as to compress the air within combustion chamber 30. The point at which piston 138 is at the end of its stroke and closest to the cylinder head (e.g. when combustion chamber 14 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 192, resulting in combustion.

During the expansion stroke, the expanding gases push piston 138 back to BDC. Crankshaft 40 converts piston movement into a rotational power of the rotary shaft. Finally, during the exhaust stroke, the exhaust valve 156 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

In some examples, vehicle 102 may be a hybrid vehicle with multiple sources of torque available to one or more vehicle wheels 55. In other examples, vehicle 102 is a conventional vehicle with only an engine, or an electric vehicle with only electric machine(s). In the example shown, vehicle 102 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Referring now to FIG. 2A, a detailed view of a fuel system that may supply fuel to engine 10 is shown. Fuel system 200 includes a fuel pump 202, a fuel filter 210, fuel line 212, a diaphragm valve 208, fuel injectors 66, a fuel regulator 206, fuel rail 207, and a fuel tank 204. Fuel injectors 66 may be the fuel injectors 166 and/or 170 in FIG. 1. Fuel filter 210 and diaphragm valve 208 are shown outside of fuel tank 204, but in some examples they may be positioned inside of fuel tank 204. Further a check valve 214 may be coupled to the fuel line 212 upstream of downstream of the diaphragm valve 208. Fuel pump 202 provides motive force to move fuel from fuel tank 204 to fuel filter 210 where contaminants may be removed from the fuel. Pressurized fuel may open diaphragm valve 208 and check valve 214 allowing fuel to flow to fuel rail 207 and fuel injectors 66. Diaphragm valve 208 may be positioned along fuel line 212 downstream of outlet 202*a* of fuel pump 202 and fuel filter 210 so that compliance of fuel filter 210 may not affect fuel pressure in fuel rail 67 during diurnal heating and cooling of the fuel system. When the fuel injectors are not being opened often, the pressure at the pump outlet may substantially equalize with fuel rail pressure and flow ceases and check valve 214 closes. However, valve 208 remains open as long as pump 202 is producing a pressure exceeding a threshold above fuel tank pressure. The diaphragm valve 208 may include a pressure port that is referenced to fuel tank pressure such that ion an event of the diaphragm being permeated or leaking, the fuel may drain back to the fuel tank.

The diaphragm valve 208 may include a chamber divided into a working chamber and a spring chamber, a diaphragm physically separating the working chamber from the spring chamber. A spring may be housed within the spring chamber, and the diaphragm may be translationally moved along the chamber of the diaphragm valve via extension and contraction of the spring. An inlet port may couple the fuel pump to the working chamber, an outlet port may couple the fuel rail 207 to the working chamber, and a weep port may couple the fuel tank to the spring chamber. Upon closing of the diaphragm valve 208, the spring may be fully extended and the diaphragm may be in face sharing contact with a seal closing a flow path between the inlet port and the outlet port, thereby restricting fuel flow via the fuel line 212. Upon opening of the diaphragm valve 208, the spring may be at least partly compressed and the diaphragm is receded from the seal opening a flow path between the inlet port and the outlet port via the working chamber, thereby allowing flow of fuel from the pump 202 to the fuel rail 207.

FIG. 2A shows relative positioning of the components in the fuel system 200. As an example, if no component is shown between two components such as in the line connecting the two components then that portion of the line is free of any of other components or connections. In one example, there may not be any other component positioned between the diaphragm valve 208 and the check valve 208.

Referring now to FIG. 2B, a cross section of fuel line 212 is shown. Fuel line 212 has an inside diameter 220 that is hollow to allow fuel to flow through. The inside diameter 220 may influence the amount of fuel that may flow through fuel line 212 in a given amount of time.

Referring now to FIG. 3A, an example diaphragm valve 208 is shown. The diaphragm valve 208 may include a housing 304, a diaphragm 326 stretched from one end of the housing 304 to an opposite end of the housing 304, and a spring 330. The diaphragm 336 may separate the area enclosed within the housing between a working chamber 332 and a spring chamber 328. The housing 304 may be cylindrical in shape with the cross-section remaining uniform throughout the working chamber 332 and the spring chamber 328. The spring 330 may occupy the spring chamber 328 and the area distribution between the working chamber 332 and spring chamber 328 may be changed by compressing and extending the spring 330. A first end of the spring 330 may be coupled to a housing wall at a first end 246 of the housing 304 while the second end of the spring 330 may be in face sharing contact with the diaphragm 326 such that the diaphragm 326 may be translationally shifted upon expansion and contraction of the spring 330. A ratio between a first area enclosed by the working chamber 332 and a second area enclosed by the spring chamber 328 may be adjustable by the translational motion of the diaphragm 326 achieved via extension or compression of the spring.

An inner wall of a second end 244 of the housing 304 may include a first protrusion (first seal) 322 and a second protrusion (second seal) 324. Upon maximal extension of the spring 300, the diaphragm 326 may extend towards the second end 244 of the housing 304 and touch each of the first protrusion 322 and the second protrusion 324. Upon contacting each of the first protrusion 322 and the second protrusion 324, an annular seal may be formed and the diaphragm 326 may not be moved further towards the second end 244 and the diaphragm valve is closed. Therefore, in the open position of the diaphragm valve (as shown in FIG. 3A), the diaphragm 326 is not contacting the first protrusion 322 and the second protrusion 324.

Each of an inlet port 312 and an outlet port 308 may be coupled to working chamber 332 of the housing 304. A weep port 360 may be coupled to the spring chamber 328 of the housing at the first end 246 of the housing 304. A conventional check valve 214 may be coupled to the outlet port 308 of the diaphragm valve. When the diaphragm valve is open, fuel from a fuel tank may enter the diaphragm valve 208 via the inlet port 312 and exit the diaphragm valve 208 via the outlet port 308 or the weep port 360. When the diaphragm valve 208 is closed, fuel from a fuel tank may enter the annular seal formed by the diaphragm 326 and the first and second protrusions 322, 324 via the inlet port 312, and may not flow out of the outlet port 308. In this way, by feeding the fuel pump outlet into the center of the valve and having it exit at the larger annulus, sealing of the diaphragm valve 208 may be improved.

The diaphragm 326 may be formed such that force of spring 330 is overcome when a predetermined fuel pressure (e.g., 10 psi) differential is present between inlet port 312 and weep port 360 or when a substantially lower fuel pressure (e.g., 10 kPa) differential is present between outlet port 308 and weep port 360. Thus, once diaphragm valve 208 is open, a mere 10 kPa pressure differential may keep diaphragm valve 208 open so that fuel pump experiences a low pressure loss flow path between pump and fuel injector, thus minimizing pump energy required. When the diaphragm valve 208 is open, the pressure drop across the diaphragm valve 208 is negligible (e.g. 1.5 kPa). Diaphragm valve 208 remains closed until the pump outlet pressure is a predetermined pressure (e.g., 10 psi) above fuel tank pressure. Once diaphragm valve 208 is open, it stays open as long as pump outlet pressure remains at least 10 psi above fuel tank pressure. When diaphragm valve 208 is open, conventional check valve 214 governs the allowed fuel flow direction while it imposes a minimal pressure drop. The pressure loss across conventional check valve 214 may be in a range of 5-20 kPa.

The diaphragm valve 208 operates as follows: First, conventional check valve 214 positioned downstream of diaphragm valve 208 in the direction of fuel flow prevents fuel flow from the fuel rail back to the tank when fuel pressure in the diaphragm valve 208 is less than fuel pressure in the fuel rail. As an example, in the case of a fuel tank vented to atmosphere, it may take 1.5 psi to prevent fuel siphoning out of a disconnected fuel line. In the case on a fuel system pressurized to 6 psi, it may take 7.5 psi to prevent fuel from siphoning out of a disconnected line. Plug-in hybrid vehicles typically have pressurized fuel systems since they may operate for months without gasoline use and thus seek to prevent release of fuel vapors into the atmosphere. The diaphragm valve 208 prevents a deep vacuum that may occur in the fuel rail thus refilling the fuel rail during pump off. The diaphragm valve 208 opens when the fuel pump pressure exceeds tank pressure by 10 psi, which it easily does anytime the pump is on. However, unlike a typical two-port check valve, the diaphragm valve 208 does not provide a pressure drop when open or fuel is flowing. It simply "gets out of the way and then stays out of the way" if the pump pressure is 10 psi above the tank pressure, which occurs anytime the pump is on. When the fuel pump 202 is off, the diaphragm valve 208 is closed by being inherently sealed. The diaphragm valve's inlet and weep port 360 are exposed to tank pressure when it is closed and the only way to open it then is by raising the inlet pressure high enough above the tank pressure (i.e. turning the pump on) in order to overcome the force of the spring. Thus, the diaphragm valve 208 remains closed during conditions of fuel rail vacuum, thereby preventing the fuel system from refilling with fuel when the fuel pump is off. Also, vacuum in the fuel rail may only pull the diaphragm closed more tightly due to tank/atmospheric pressure pushing on the spring side of the diaphragm.

The diaphragm valve 208 opens with a calibratable or tuned amount of pressure. By being able to open the diaphragm valve with a smaller calibratable pressure, power consumption of a fuel pump for opening the diaphragm valve 208 may be reduced. The amount of pressure may be based on the characteristics (elasticity) of the diaphragm 326 and force of spring 330, which form a force balance. When the pump 202 is off, the vacuum force required to open diaphragm valve 208 is governed by the spring force and the characteristics (elasticity) of the diaphragm 326. Vacuum in the fuel rail will pull the valve closed. Vacuum in the tank may momentarily open the valve but then check valve 214 will prevent tank vacuum from removing any fuel from the lines/rail through valve 208.

The combination of diaphragm valve 208 and check 214 gives the valve system the following desired behaviors: First, it prevents fuel flow from the fuel rail back to the tank in all conditions. In addition, the diaphragm valve 208 takes 10 psi to open to impede natural, unintentional siphoning out of the tank if there is a break in the fuel line downstream of the diaphragm valve 208 and the fuel pump is off. Further, the check valve 214 prevents the vacuum pressure (tank pressure minus fuel vapor pressure) from drawing fuel into the fuel tank.

FIG. 3A shows diaphragm valve 208 in an open position such as when the fuel pump is operating. The spring 330 may be at least partially compressed and the diaphragm 326 may not be contacting the first protrusion 322 and the second protrusion 324. Fuel may enter the working chamber 332 via the inlet port 312 and then flow to the fuel rail 207 and fuel injectors 66 via the outlet port 308. A weep hole may be present along the diaphragm 326 or at a junction of the diaphragm 326 and the walls of the housing via which fuel may enter the spring chamber 328 from the working chamber 332. This fuel may return to the fuel tank via the weep port 360. The volume 328 or the ports 360 may see liquid fuel, fuel vapor, and/or even air in certain conditions. Regardless of the fluid contained, it is substantially at tank pressure.

FIG. 3B shows diaphragm valve 208 in a fully closed position. Spring 330 may bias diaphragm valve 208 to a fully closed position when fuel pump 202 is in an off state. The spring 330 may be completely extended and the diaphragm 326 may be contacting each the first protrusion 322 and the second protrusion 324 thereby sealing the communication between the inlet port 312 and the outlet port 308 via the working chamber 332.

FIGS. 3A-3B show relative positioning of the components in the diaphragm valve 208 system. As an example, if no component is shown between two components such as in the line connecting the two components then that portion of the line is free of any of other components or connections. In another embodiment, the outlet port 308 may be coupled to the diaphragm valve 208 between the first protrusion 322 and the second protrusion 324 while the inlet port 312 may be coupled to the diaphragm valve 208 between the first protrusion 322 and one end of the diaphragm valve 208.

The system of FIGS. 1-3B provides for a fuel system, comprising: a fuel pump, a diaphragm valve arranged in a fuel line downstream of the fuel filter, and a fuel rail arranged in the fuel line downstream of the diaphragm valve, the diaphragm valve comprising: a housing including a working cavity having a first area and a spring cavity having a second area separated via a diaphragm, and a spring coupled to the diaphragm.

Figure 4:
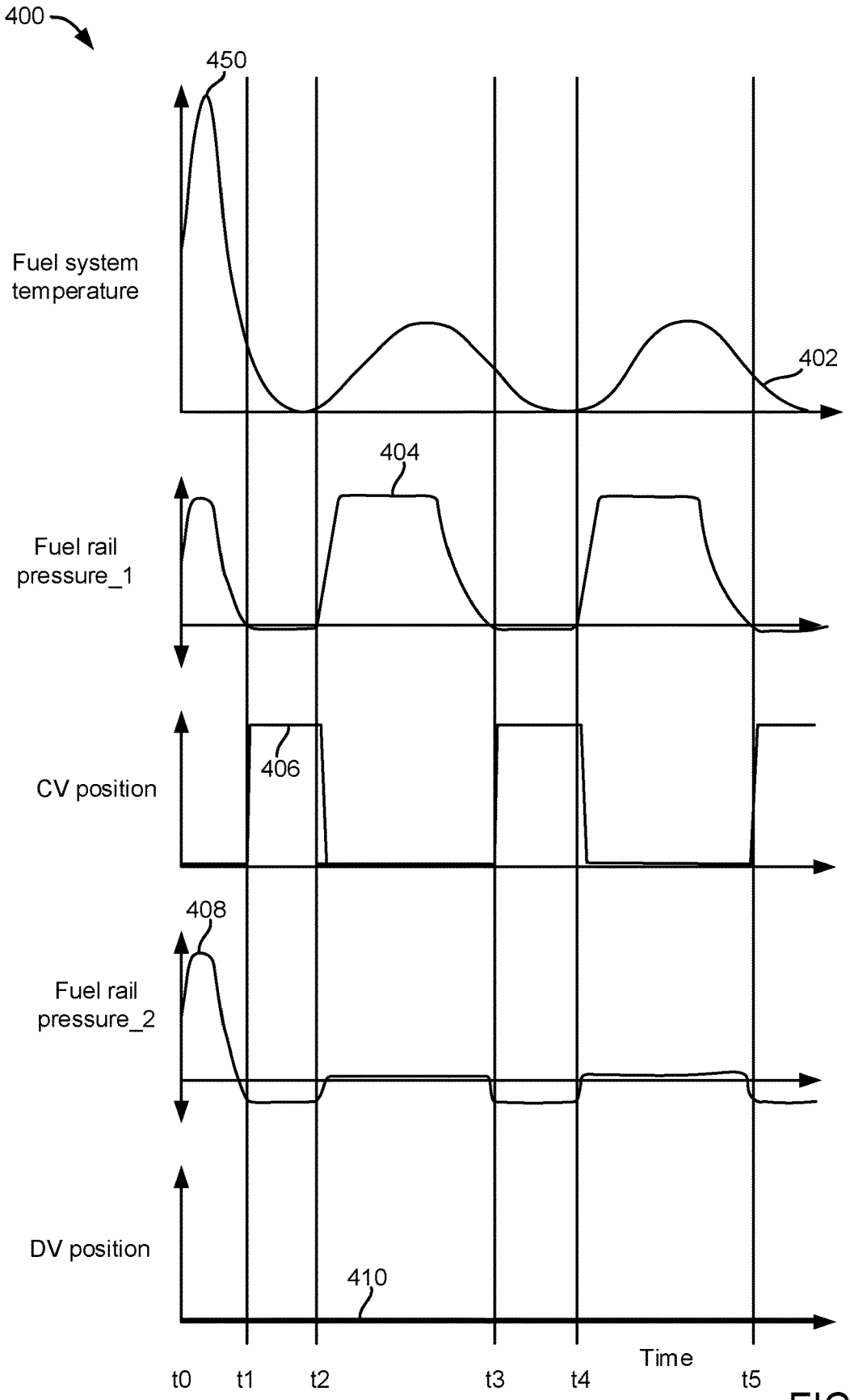
FIG. 4 shows a diurnal sequence that contrasts operation of a fuel system that includes a prior art check valve and operation of a fuel system that includes a diaphragm valve according to the present disclosure.

Referring now to FIG. 4, a prophetic example 400 operating sequence for a conventional fuel line check valve is contrasted with an operating sequence for the diaphragm valve (such as diaphragm valve 208) described herein. The operating sequence illustrates three diurnal heating and cooling periods, and the conventional fuel line check valve and the diaphragm are exposed to the same operating conditions. The plots are time aligned and occur at a same time.

The first plot 402 from the top is a plot of fuel system temperature (e.g., fuel temperature within a fuel rail of fuel systems that include the conventional check valve and the diaphragm valve) when a vehicle's engine is stopped and the vehicle is stationary. The vertical axis represents temperature and temperature increases in the direction of the vertical axis arrow. The horizontal axis represents time and time increases from the left side of the figure to the right side of the figure. The low diurnal temperature may be 65° F. and the high might be 105° F. while the underhood peak temperature occurring typically 20 minutes past engine off may be 145° F.

The second plot 404 is a plot of fuel rail pressure for a fuel system that includes a conventional check valve (fuel rail pressure_1) when a vehicle's engine is stopped and the vehicle is stationary. The vertical axis represents pressure and pressure increases in the direction of the vertical axis arrow. The horizontal axis represents time and time increases from the left side of the figure to the right side of the figure.

The third plot 406 is a plot of conventional check valve position (CV position) versus time. The vertical axis represents the conventional check valve metering valve position and the conventional check valve opening amount increases as the check valve metering valve position increases in the direction of the vertical axis arrow. The horizontal axis represents time and time increases from the left side of the figure to the right side of the figure.

The fourth plot 408 a plot of fuel rail pressure for a fuel system that includes the diaphragm valve (fuel rail pressure_2) when a vehicle's engine is stopped and the vehicle is stationary. The vertical axis represents pressure and pressure increases in the direction of the vertical axis arrow. The horizontal axis represents time and time increases from the left side of the figure to the right side of the figure.

The fifth plot 410 is a plot of diaphragm valve position (DV position) versus time. The vertical axis represents the diaphragm valve position and the diaphragm valve opening amount increases in the direction of the vertical axis arrow.

The horizontal axis represents time and time increases from the left side of the figure to the right side of the figure.

At time t0, an engine of a vehicle that is combusting fuel stops combusting fuel and is stopped (not shown). Pressure in the engine's fuel line begins to increase as heat from the engine is not removed from the engine compartment since the engine is off and the vehicle is stopped. Pressure in the fuel rail of fuel system with the conventional check valve increases as temperature (thus volume) within the fuel rail is increased. The conventional check valve is fully closed at time t0. Pressure in the fuel rail of the fuel system with the diaphragm valve also increases as temperature within the fuel rail is increased. The diaphragm valve is fully closed at time t0.

Between time t0 and time t1, the temperature of the fuel system increases and then it decreases as the fuel system is cooled toward ambient temperature. Pressure in the fuel rail of fuel system with the conventional check valve increases and then decreases as temperature within the fuel rail is increased and decreased. The conventional check valve is fully closed. Pressure in the fuel rail of fuel system with the diaphragm valve also increases and then decreases as temperature within the fuel rail is increased. The diaphragm valve remains fully closed. The peak pressure may be limited at this stage by the pressure regulator 206.

At time t1, the temperature of the fuel system has been reduced low enough for a vacuum to be generated in the fuel line of the system that includes the conventional check valve. This occurs when the fuel's vapor pressure drops below atmospheric pressure. For example, if the fuel rail contains some air, the pressure may be slightly above fuel vapor pressure. Dissolved air comes out of the fuel when it drops below atmospheric pressure due to the Bunsen effect. The vacuum is large enough to cause the conventional check valve to open, which allows additional fuel to enter the fuel rail from the fuel tank. The vacuum overcomes the spring force within the conventional check valve since the conventional check valve is designed to open at a lower pressure differential. A vacuum is also generated in the fuel system that includes the diaphragm valve; however, the diaphragm valve remains closed since vacuum acting on the outlet port cannot cause the diaphragm valve to open. Thus, the diaphragm valve prevents additional fuel from entering the fuel system. By preventing additional fuel from entering the fuel system, it may be possible for pressure in the fuel system to remain lower during diurnal heating.

Between time t1 and time t2, the temperature of the fuel system is reduced further and the vacuum in the fuel line of the system that includes the conventional check valve is maintained. The vacuum continues to hold the conventional check valve to open, which allows additional fuel to enter the fuel rail from the fuel tank. Vacuum in the fuel system that includes the diaphragm valve is increased, but the diaphragm valve remains closed since vacuum acting on the outlet port cannot cause the diaphragm valve to open.

At time t2, the temperature of fuel in the fuel system begins to increase due to diurnal heating. The increase in temperature begins to raise pressure in the system that includes the conventional check valve. The conventional check valve remains open. The increase in temperature also raises pressure in the system that includes the diaphragm valve. The diaphragm valve remains closed.

Between time t2 and time t3, temperature in the fuel systems increases and then it decreases due to diurnal heating and cooling as the vehicle's engine remains off. Pressure in the fuel system that includes the conventional check valve increases and then it decreases. When higher pressures are in the fuel system, the possibility of fuel unintentionally entering the engine from fuel injectors may increase. Pressure in the fuel system that includes the diaphragm valve increases and then it decreases, but its pressure increase is significantly lower than that of the system that includes the conventional check valve because less fuel may be in the fuel rail of the system that includes the diaphragm valve. The conventional check valve is closed and the diaphragm valve remains closed. Conventionally, the fuel system drinks in fuel as the temperature drops (and forms a vacuum) and pushes out fuel when the temperature climbs (once reaching the regulated pressure).

At time t3, the temperature of the fuel system has been reduced low enough for a vacuum to be generated in the fuel line of the system that includes the conventional check valve a second time. The vacuum is large enough to cause the conventional check valve to open, which allows additional fuel to enter the fuel rail from the fuel tank again. A vacuum is also generated in the fuel system that includes the diaphragm valve again, but the diaphragm valve remains closed since vacuum acting on the outlet port cannot cause the diaphragm valve to open.

Between time t3 and time t4, the temperature of the fuel system is reduced further and the vacuum in the fuel line of the system that includes the conventional check valve is maintained. The vacuum continues to hold the conventional check valve to open, which allows additional fuel to enter the fuel rail from the fuel tank. Vacuum in the fuel system that includes the diaphragm valve is maintained, but the diaphragm valve remains closed since vacuum acting on the outlet port cannot cause the diaphragm valve to open.

At time t4, the temperature of fuel in the fuel system begins to increase due to diurnal heating. The increase in temperature begins to raise pressure in the system that includes the conventional check valve. The conventional check valve remains open. The increase in temperature also raises pressure in the system that includes the diaphragm valve. The diaphragm valve remains closed.

Between time t4 and time t5, temperature in the fuel systems increases and then it decreases due to diurnal heating and cooling as the vehicle's engine remains off. Pressure in the fuel system that includes the conventional check valve increases and then it decreases. Pressure in the fuel system that includes the diaphragm valve increases and then it decreases, but again, its pressure increase is significantly lower than that of the system that includes the conventional check valve because less fuel may be in the fuel rail of the system that includes the check valve described herein. The conventional check valve is closed and the diaphragm valve remains closed.

At time t5, the temperature of the fuel system has been reduced low enough for a vacuum to be generated in the fuel line of the system that includes the conventional check valve a second time. The vacuum is large enough to cause the conventional check valve to open, which allows additional fuel to enter the fuel rail from the fuel tank again. A vacuum is also generated in the fuel system that includes the diaphragm valve again, but the diaphragm valve remains closed since vacuum acting on the outlet port cannot cause the diaphragm valve to open.

Thus, in the fuel system with the conventional check valve, fuel in the fuel rail may be recharged via diurnal heating and cooling so that a possibility of fuel entering the engine via the fuel injectors may increase. On the other hand, the fuel system that includes the diaphragm valve does not allow additional fuel to enter the fuel rail during diurnal cooling so that a possibility of fuel pressure increasing to a point where fuel flows through the fuel injectors during diurnal heating may be reduced.

Figure 5:
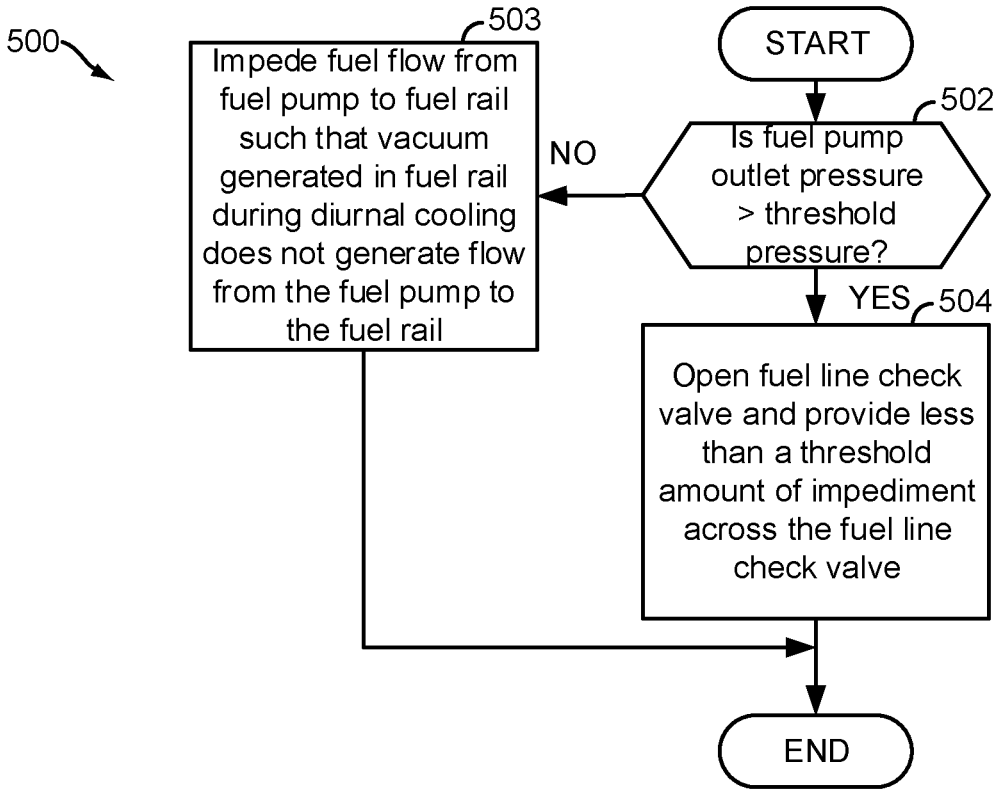
FIG. 5 shows a flow chart of a method for operating a fuel system that includes a diaphragm valve.

Referring now to FIG. 5, a flow chart 500 of a method for operating an engine that includes a diaphragm valve as described herein is shown. The method of FIG. 5 may be performed via the system shown in FIGS. 1-3B.

At 502, method 500 judges if the fuel pump's outlet pressure is greater than a threshold pressure. The threshold pressure may be pre-calibrated as an estimated fuel tank pressure plus a constant (such as fuel tank pressure+12 psi) During operation of the pump, the fuel pump's outlet pressure may be 40 psi. By opening the valve only upon the pressure reaching the threshold pressure, flow of fuel from the fuel line may be prevented unless the pump is on.

If so, the answer is yes and method 500 proceeds to 504. Otherwise, the answer is no and method 500 proceeds to 503. The diaphragm valve described herein may not open while a fuel pressure difference across the diaphragm valve is less than a first fuel pressure difference (e.g. pressure difference between the fuel pump outlet and the fuel tank). The spring of the valve may be extended and the diaphragm of the valve may be in face sharing contact with the seals thereby closing off the working chamber of the valve from fuel flow. The diaphragm valve may also remain open in response to a reduced fuel pressure difference between pressure at the outlet of the fuel pump and fuel tank pressure. The diaphragm valve may remain open at a reduced pressure difference between the outlet pressure of the fuel pump and the fuel tank.

At 504, method 500 opens the diaphragm valve and provides less than a threshold amount of impediment (e.g., less than 1.5 KPa) to fuel flow across the diaphragm valve. Method 500 proceeds to exit.

At 503, method 500 impedes fuel flow from the fuel pump to the fuel rail such that vacuum generated in the fuel rail during diurnal cooling or fuel tank pressure is insufficient to generate flow from the fuel pump to the fuel rail. The fuel pump is off during diurnal heating and cooling. Method 500 proceeds to end.

Thus, the method of FIG. 5 provides for a method for a fuel system, comprising: preventing, via a spring and a diagram of a diaphragm valve, opening of the diaphragm valve coupled to a fuel line while a fuel pressure difference across the diaphragm valve is less than a first fuel pressure difference, and reducing, via the spring and the diagram of the diaphragm valve, the fuel pressure difference across the diaphragm valve to less than a second fuel pressure difference after the diaphragm valve begins to open, the second fuel pressure difference lower than the first fuel pressure difference.

In this way, the diaphragm valve described herein may open at a first pressure, but it may be held open via a lower pressure so that pumping efficiency may remain high. In addition, the check valve described herein may prevent fuel from passing through the check valve during diurnal heating and cooling of the fuel system.

An example fuel system comprises: a diaphragm valve coupled to a fuel line between a fuel pump and a fuel rail, the diaphragm valve including a diaphragm movable within a chamber of the diaphragm valve via a spring. In the preceding example, additionally or optionally, the chamber of the diaphragm valve is divided into a working chamber and a spring chamber, the diaphragm separating the working chamber from the spring chamber. In any or all of the preceding examples, additionally or optionally, the spring is housed within the spring chamber, and the diaphragm is translationally moved along the chamber of the diaphragm valve via extension and contraction of the spring. Any or all of the preceding examples, further comprising, additionally or optionally, each of an inlet port coupled to the working chamber, an outlet port coupled to the working chamber, and a weep port coupled to the spring chamber. In any or all of the preceding examples, additionally or optionally, the inlet port is coupled to the fuel pump, wherein the outlet port is coupled to the fuel rail via a check valve, and wherein the weep port (which may also be referred to as a reference pressure port) is coupled to a fuel tank. In any or all of the preceding examples, additionally or optionally, upon closing of the diaphragm valve, the spring is fully extended and the diaphragm is in face sharing contact with a seal closing a flow path between the inlet port and the outlet port. In any or all of the preceding examples, additionally or optionally, upon opening of the diaphragm valve, the spring is at least partly compressed and the diaphragm is receded from the seal opening a flow path between the inlet port and the outlet port via the working chamber. Any or all of the preceding examples, further comprising, additionally or optionally, a check valve coupled to the fuel line between the diaphragm valve and the fuel rail.

Another example method for a fuel system, comprises: preventing, via a spring and a diagram of a diaphragm valve, opening of the diaphragm valve coupled to a fuel line while a fuel pressure difference across the diaphragm valve is less than a first fuel pressure difference; and reducing, via the spring and the diagram of the diaphragm valve, the fuel pressure difference across the diaphragm valve to less than a second fuel pressure difference after the diaphragm valve begins to open, the second fuel pressure difference lower than the first fuel pressure difference. In the preceding example, additionally or optionally, the method further comprising, upon opening of the diaphragm valve, flowing a fuel from a fuel pump to a fuel rail through the diaphragm valve. Any or all of the preceding examples, further comprising, additionally or optionally, closing the diaphragm valve via deactivating a fuel pump. Any or all of the preceding examples, further comprising, additionally or optionally, preventing the fuel from flowing through the diaphragm valve when a vacuum forms in the fuel line while the fuel pump is deactivated. In any or all of the preceding examples, additionally or optionally, the opening of the diaphragm valve includes, the spring being at least partly compressed and the diaphragm receded from a seal establishing fluidic communication between an inlet port and an outlet port. In any or all of the preceding examples, additionally or optionally, the closing of the diaphragm valve includes, the spring being fully extended and the diaphragm contacting the seal disabling fluidic communication between the inlet port and the outlet port. Any or all of the preceding examples, further comprising, additionally or optionally, during a higher than threshold pressure in the fuel line, preventing back flow of the fuel from the fuel rail to the pump via a check valve coupled to the fuel line between the diaphragm valve and the fuel rail.

Another example for a fuel system, comprises: a fuel pump, a diaphragm valve arranged in a fuel line downstream of a fuel filter, and a fuel rail arranged in the fuel line downstream of the diaphragm valve, the diaphragm valve comprising: a housing including a working cavity having a first area and a spring cavity having a second area separated via a diaphragm, and a spring coupled to the diaphragm. In any of the preceding examples, additionally or optionally, the spring is housed within the spring cavity, and wherein a ratio between the first area and the second area is adjustable via extension or compression of the spring. Any or all of the preceding examples, further comprising, additionally or optionally, at least one protrusion at an end of the working cavity formed to seal the working cavity upon the diaphragm contacting the one protrusion. Any or all of the preceding examples, further comprising, additionally or optionally, a check valve arranged in the fuel line between the diaphragm valve and the fuel rail, and a fuel filter arranged in the fuel line between the fuel pump and the diaphragm valve. Any or all of the preceding examples, further comprising, additionally or optionally, each of an inlet port, an outlet port, and a weep port coupled to the housing.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. A fuel system, comprising:

a diaphragm valve coupled to a fuel line between a fuel pump and a fuel rail, the fuel pump and the diaphragm valve positioned within a fuel tank, wherein the diaphragm valve including a diaphragm movable within a chamber of the diaphragm valve via a spring, wherein the diaphragm valve is configured to open when the fuel pump exceeds a predetermined pressure above a pressure of the fuel tank such that a fuel from the fuel pump flows to the fuel rail through the diaphragm valve, wherein the diaphragm valve is further configured to close when the fuel pump is deactivated, and wherein the opening of the diaphragm valve includes the spring being at least partly compressed and the diaphragm receded from a seal establishing fluidic communication between an inlet port and an outlet port.

2. The system of claim 1, wherein the chamber of the diaphragm valve is divided into a working chamber and a spring chamber, the diaphragm separating the working chamber from the spring chamber.

3. The system of claim 2, wherein the spring is housed within the spring chamber, and the diaphragm is translationally moved along the chamber of the diaphragm valve via extension and contraction of the spring.

4. The system of claim 2, wherein the inlet port is coupled to the working chamber, the outlet port is coupled to the working chamber, and a weep port is coupled to the spring chamber.

5. The system of claim 4, wherein the inlet port is coupled to the fuel pump, wherein the outlet port is coupled to the fuel rail via a check valve, and wherein the weep port is coupled to the fuel tank.

6. The system of claim 4, wherein upon closing of the diaphragm valve, the spring is fully extended and the diaphragm is in face sharing contact with the seal closing a flow path between the inlet port and the outlet port.

7. The system of claim 6, wherein upon opening of the diaphragm valve, the flow path between the inlet port and the outlet port via the working chamber is opened.

8. The system of claim 1, further comprising a check valve coupled to the fuel line between the diaphragm valve and the fuel rail.

9. A method for a fuel system, comprising:

preventing, via a spring and a diaphragm of a diaphragm valve, opening of the diaphragm valve coupled to a fuel line while a fuel pressure difference across the diaphragm valve is less than a first fuel pressure difference; and reducing, via the spring and the diaphragm of the diaphragm valve, the fuel pressure difference across the diaphragm valve to less than a second fuel pressure difference after the diaphragm valve begins to open, the second fuel pressure difference lower than the first fuel pressure difference;

upon opening of the diaphragm valve, flowing a fuel from a fuel pump to a fuel rail through the diaphragm valve; and closing the diaphragm valve via deactivating the fuel pump;

wherein the opening of the diaphragm valve includes the spring being at least partly compressed and the diaphragm receded from a seal establishing fluidic communication between an inlet port and an outlet port.

10. The method of claim 9, further comprising preventing the fuel from flowing through the diaphragm valve when a vacuum forms in the fuel line while the fuel pump is deactivated.

11. The method of claim 9, wherein the closing of the diaphragm valve includes, the spring being fully extended and the diaphragm contacting the seal disabling fluidic communication between the inlet port and the outlet port.

12. The method of claim 9, further comprising, during a higher than threshold pressure in the fuel line, preventing back flow of the fuel from the fuel rail to the fuel pump via a check valve coupled to the fuel line between the diaphragm valve and the fuel rail.

13. A fuel system, comprising:

a fuel pump;

a diaphragm valve arranged in a fuel line downstream of a fuel filter; and a fuel rail arranged in the fuel line downstream of the diaphragm valve, the diaphragm valve comprising: a housing including a working cavity having a first area and a spring cavity having a second area separated via a diaphragm, and a spring coupled to the diaphragm, wherein the diaphragm valve is configured such that a fuel from the fuel pump flows to the fuel rail through the diaphragm valve, wherein the diaphragm valve is further configured to close when the fuel pump is deactivated, and wherein the opening of the diaphragm valve includes the spring being at least partly compressed and the diaphragm receded from a seal establishing fluidic communication between an inlet port and an outlet port.

14. The system of claim 13, wherein the spring is housed within the spring cavity, and wherein a ratio between the first area and the second area is adjustable via extension or compression of the spring.

15. The system of claim 14, further comprising, at least one protrusion at an end of the working cavity formed to seal the working cavity upon the diaphragm contacting the at least one protrusion.

16. The system of claim 13, further comprising a check valve arranged in the fuel line between the diaphragm valve and the fuel rail, and the fuel filter arranged in the fuel line between the fuel pump and the diaphragm valve.

17. The fuel system of claim 13, wherein each of the inlet port, the outlet port, and a weep port are coupled to the housing.

* * * * *